United States Patent [19]

Goldfarb et al.

[11] 4,363,186

[45] Dec. 14, 1982

[54] TOY MOTORCYCLE AND LAUNCHER

[75] Inventors: Adolph E. Goldfarb, 4614 Monarca Dr., Tarzana, Calif. 91356; Delmar K. Everitt, Woodland Hills, Calif.

[73] Assignee: Adolph E. Goldfarb, Tarzana, Calif.

[21] Appl. No.: 233,825

[22] Filed: Feb. 12, 1981

[51] Int. Cl.[3] ..... A63H 29/20

[52] U.S. Cl. ..... 46/209; 46/202; 46/106

[58] Field of Search ..... 46/206, 209, 202, 101, 46/106, 248, 269, 251, 45

[56] References Cited

U.S. PATENT DOCUMENTS

| | | | |
|---|---|---|---|
| 3,559,335 | 2/1971 | See | 46/248 X |
| 3,621,607 | 12/1969 | Morrison et al. | 46/206 |
| 3,686,790 | 8/1972 | Winston | 46/206 X |
| 3,803,756 | 4/1974 | Strongin | 46/209 X |
| 3,886,682 | 6/1975 | Ieda et al. | 46/209 X |
| 3,895,458 | 7/1975 | Lemelson | 46/209 X |

FOREIGN PATENT DOCUMENTS

| | | | |
|---|---|---|---|
| 1029719 | 5/1958 | Fed. Rep. of Germany | 46/209 |
| 1427941 | 3/1976 | United Kingdom | 46/202 |

*Primary Examiner*—Mickey Yu

*Attorney, Agent, or Firm*—Romney, Golant, Martin, Disner & Ashen

[57] ABSTRACT

Toy motorcycle play apparatus comprising a toy motorcycle having an energy-storing drive-train mechanism, and a launcher for imparting energy to the mechanism and then releasing the motorcycle for forward movement. The motorcycle comprises aligned rotatable front and rear ground-engaging wheels and an intermediate flywheel, all rotatable about horizontal transverse axes. The energy-storing drive-train mechanism is formed by the flywheel, one of the wheels, and a gear train between them which reduces speed and increases power and duration of rotation at that drive wheel. In operation, the motorcycle is powered by the flywheel, which also serves to maintain it upright by gyroscopic action as it moves forwardly. The launcher holds the motorcycle in the desired upright orientation with the drive wheel elevated so that it can rotate freely while energy is being stored in the flywheel. Then the motorcycle is released, the drive wheel is allowed to engage the launcher platform and propel the motorcycle forwardly. In a motorized version, a movable arm on the launcher carries a motor-drive power-transmitting drum. Initially, the arm is moved so that the drum directly engages the periphery of the flywheel on the motorcycle to transfer energy to the flywheel. When the arm is moved away, the power-transmitting drum disengages and the motorcycle is released. In a hand-powered version, a device such as a toothed rack may be pulled by the user to impart energy to the flywheel, and also to then automatically lower and release the motorcycle.

44 Claims, 14 Drawing Figures

TOY MOTORCYCLE AND LAUNCHER

FIELD OF THE INVENTION

Toy vehicles and launchers therefore, particularly toy vehicles having an energy-storing drive mechanism.

BACKGROUND OF INVENTION

Toy vehicles with energy-storing drive mechanisms are very popular. Typically one or more ground engaging drive wheels is fixed or geared to a flywheel on the vehicle. The user may grasp the vehicle in his or her hand and repeatedly run it along the ground to impart rotation to the drive wheel, which in turn imparts rotation to the flywheel. Thus, the momentum of the flywheel stores energy so that when the user places the vehicle on the ground, the energy is transmitted to the drive wheel to power the vehicle forwardly. Various launching devices have been used for such toy vehicles.

U.S. Pat. No. 3,471,963 to Tomiyama, simulates the manual operation described above by holding a rear drive wheel of a toy 4-wheel car against a motor-powered rotating drum to impart energy to a friction motor. When the wheels are going fast enough, the car overcomes stop means and moves forwardly. The car is supported on four wheels and is not gyroscopically balanced as it moves.

U.S. Pat. No. 3,803,756 to Strongin discloses a launcher which holds a toy car with its combination rear flywheel/drive wheel off the ground while energy is imparted from a motor to that flywheel/drive wheel by means of a releasable coupling between the end of the shaft of the flywheel/drive wheel and the shaft of the motor. Then the coupling is disengaged by transverse movement and the car is lowered, permitting the car to move forwardly, balanced on its two front wheels and its single rear flywheel/drive wheel.

The German Pat. No. 1,029,719 shows a toy motorcycle having aligned front and rear wheels, but balanced by a pair of support wheels each positioned at one side of the motorcycle. This toy motorcycle includes a flywheel geared to a rear drive wheel. The flywheel is engaged by motor-operated power-transmitting means on a launcher to impart energy to the flywheel. However the flywheel is on a movable vertical shaft that is depressed to couple it with the power-transmitting means, and it appears also to disengage from the rear drive wheel while in this position. The flywheel shaft then moves back upwardly to disengage from the power transmitting means and to re-engage with the drive wheel, and the motorcycle moves forwardly.

U.S. Pat. No. 3,789,540 to Convertine discloses a 4-wheel toy car and launcher. The car is elevated off the ground while an air pump imparts energy to a combination turbine/flywheel that is geared to the drive wheels of the car. The car is then lowered and released for forward movement.

U.S. Pat. No. 3,621,607 to Morrison discloses a gyroscopically balanced toy vehicle with a launcher. The toy vehicle has only a single wheel which combines the drive wheel and the flywheel; thus, there is no lowering of speed or increasing of power and duration of rotation of the drive wheel with regard to the flywheel.

SUMMARY OF DISCLOSURE

The presently preferred and illustrated form of the invention contemplates a two-wheeled gyroscopically-balanced toy vehicle and an associated launcher. The illustrated toy vehicle is in the form of a toy motorcycle having a flywheel for storing rotational energy. The flywheel is coupled to a rear drive wheel of the vehicle, as by a gear train which reduces speed while increasing power and duration of rotation to the drive wheel. The launcher has a platform and holds the motorcycle in the desired orientation, upright and with the drive wheel elevated off the platform, imparts energy to the flywheel, and then lowers and releases the motorcycle for forward movement under its own power. More particularly, when the motorcycle is lowered and released, the drive wheel engages the platform to propel the motorcycle forwardly, while the flywheel continues to rotate to provide power to the drive wheel and also acts to maintain the motorcycle upright in its travel by virtue of gyroscopic action. One illustrated embodiment comprises a motor-driven power-transmitting drum mounted on a movable arm pivotally supported on the launcher. By moving the arm, the outer edge of the rotating power-transmitting drum is moved against the outer edge of the flywheel on the motorcycle to impart rotation to the flywheel. Then when the arm is again moved in the opposite direction, the power-transmitting drum disengages and the motorcycle is lowered and released. In a manually powered version, the toy motorcycle is held by the launcher while the user imparts energy to the flywheel, as by pulling a rack engaged with a gear on the drive wheel. When the rack disengages, the toy motorcycle is thereby automatically permitted to move to where it is released from the launcher and the drive wheel engages the launcher platform to propel the motorcycle forwardly.

IN THE DRAWINGS

DETAILED DESCRIPTION OF THE EMBODIMENTS

Figure 6:
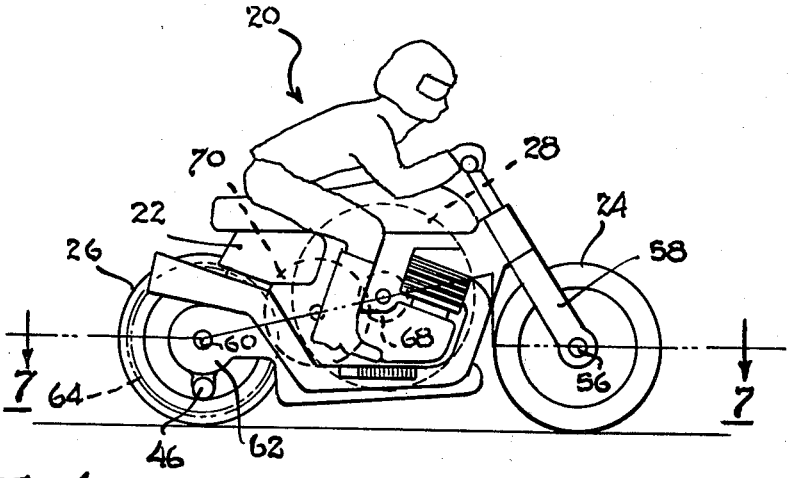
FIG. 6 is a side elevational view of a toy motorcycle for use with the launcher.
Figure 5:
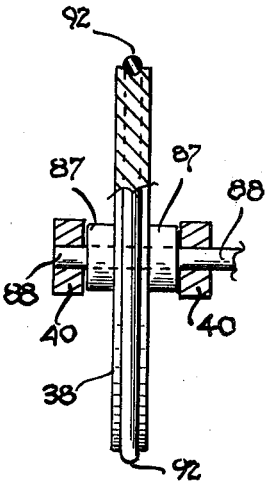
FIG. 5 is a sectional view taken generally along line 5—5 of FIG. 2, showing the power imparting wheel.
Figure 7:
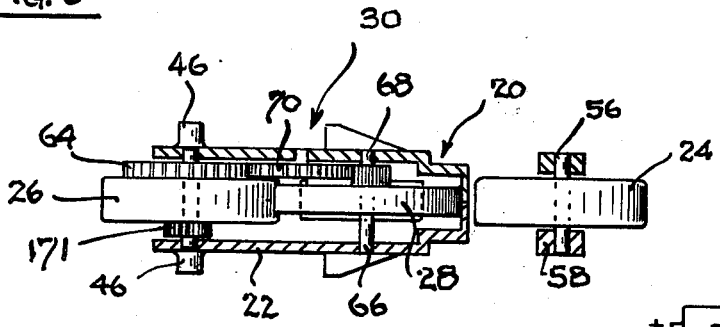
FIG. 7 is a sectional view taken generally along line 7—7 of FIG. 6.
Figure 8:
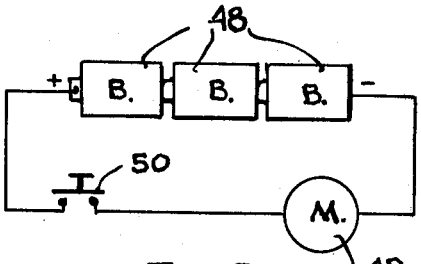
FIG. 8 is a schematic electrical diagram for the launcher.
Figure 7A:
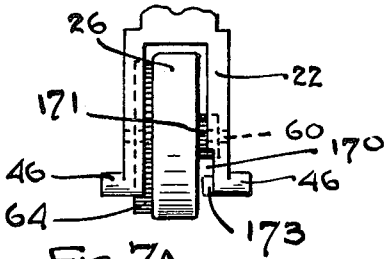
FIG. 7A is a rear end view of the toy motorcycle.

In general, the illustrated toy motorcycle play apparatus comprises a toy motorcycle 20 as shown in FIGS. 6, 7 and 7A, a motorized form of launcher 22 as shown in FIGS. 1–5 and 8, and an alternative hand-powered form of launcher 122 as shown in FIGS. 9–12.

In general, the toy motorcycle 20 comprises a frame 22, a rotatable front wheel 24, a rotatable rear drive wheel 26, and a rotatable energy storing flywheel 28 positioned intermediate the front and rear wheels. The front and rear wheels and the flywheel are rotatable mounted on the frame 22 on horizontal, transversely extending axes, and they all lie in a vertical plane extending down the center of the toy motorcycle. The flywheel 28 is coupled to the rear drive wheel 26 by a gear train 30 which reduces speed while increasing power and duration of rotation at the rear wheel. Thus in operation, the flywheel 28 stores rotational energy and transmits it to the rear ground-engaging drive wheel 26 while also providing gyroscopic balance which maintains the motorcycle generally upright during its forward travel.

Figure 1:
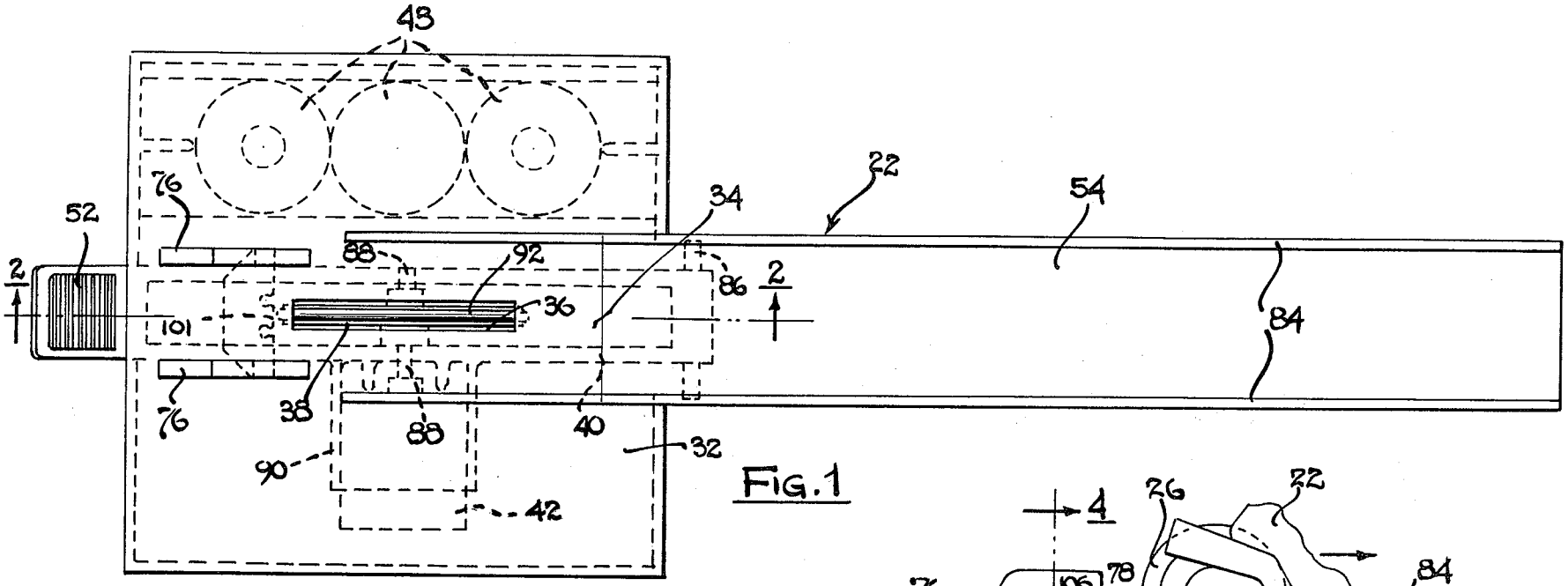
FIG. 1 is a plan view of a launcher of a toy motorcycle play apparatus which embodies the invention.
Figure 2:
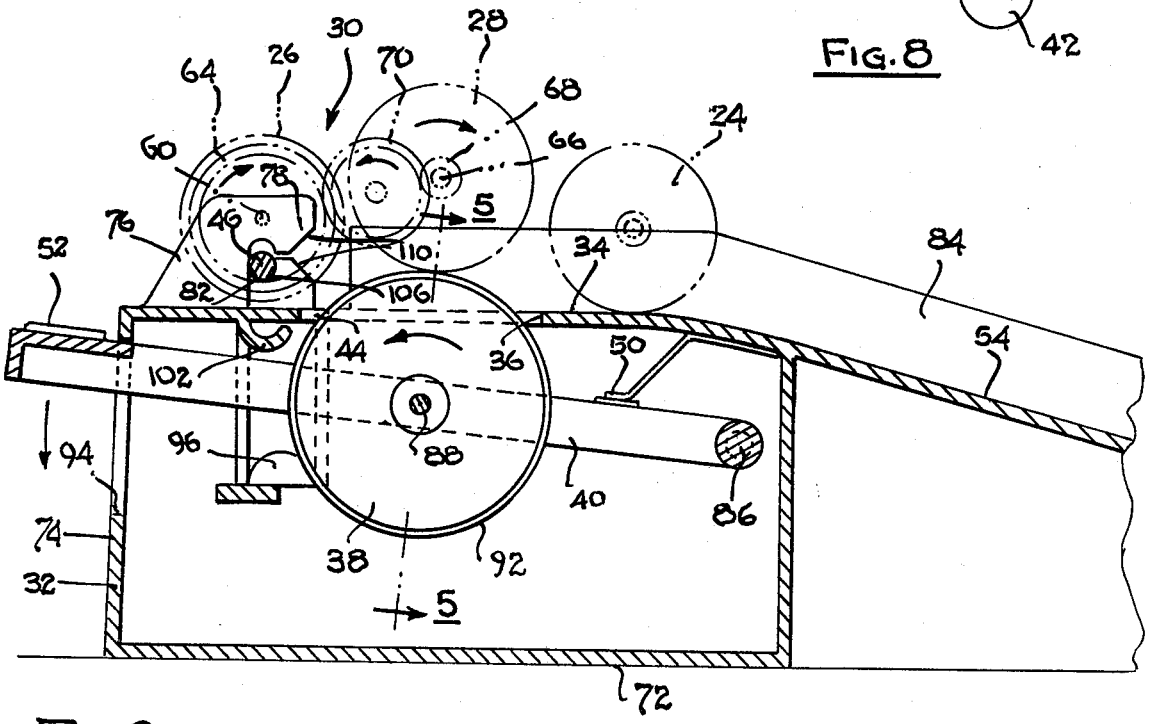
FIG. 2 is an enlarged side sectional view taken generally along line 2—2 of FIG. 1, showing in phantom certain elements of a toy motorcycle while it is mounted on the launcher and energy is being imparted to it.

The motor-powered launcher 22 illustrated in FIGS. 1–5 and 8, comprises generally a base or housing 32 having a top wall 34 that forms a launching platform on which the toy motorcycle 20 is releasably held (as illustrated by phantom line representation in FIG. 2 of the front, rear and flywheels and the train gearing). In this position the motorcycle is supported and retained with its rear drive wheel 26 elevated off the platform 34, and with the flywheel 28 aligned with a longitudinally extending slot 36 in the platform. In this connection, a U-shaped support or yoke 44 has a pair of legs that support pins 46 fixed on opposite sides of the motorcycle rear end to lift the rear end of the motorcycle, restraining it from forward movement, and maintaining it in the desired upright orientation. An energy-imparting wheel or drum 38 is rotatably supported on a manually movable arm 40 in the housing 32 so that the upward edge of the drum 38 may be moved upwardly through the slot 36 to engage the edge of the flywheel 28 to transfer rotational motion and energy to the flywheel. The arm 40 also supports an electric motor 42 that drives the wheel 38. As the arm 40 moves upwardly toward the position shown in FIG. 2, but before the drum 38 engages the motorcycle flywheel 28, the movement of the arm closes a switch 50 which completes a circuit between the motor 42 and batteries 48 also mounted within the housing to energize the motor.

After the flywheel 28 is going fast enough, the user may manually lower the arm 40 to first disengage the wheel 38 from the flywheel 28 and next open the switch 50 to de-energize the motor 42. The arm 40 is coupled to the yoke 44 so that continued lowering of the arm also lowers the yoke 44 to lower the rear drive wheel 26 of the motorcycle to the platform 34 and disengage the yoke from the side pins 46 so that the drive wheel can propel the motorcycle forwardly along the platform. The illustrated platform 34 has a forwardly and downwardly extending ramp 54 to contribute to the forward momentum of the motorcycle.

Now considering the illustrated apparatus in further detail, the toy motorcycle 20 is illustrated best in FIGS. 6, 7 and 7A. It comprises the generally upright frame 22. The forward wheel 24 is rotatably mounted on a transverse axle 56 between a bifurcated fork portion 58 at the forward end of the frame 22. Similarly rotatably mounted on a transverse shaft 60 between a bifurcated forked portion 62 at the rear of the frame, is the rear drive wheel 26. The rear drive wheel 26 is generally aligned with the forward wheel 24 and is substantially thicker than the slot 36 in the launcher platform. A gear 64 is carried at one side of the rear drive wheel 26. The flywheel 28 is rotatably supported on a transverse shaft 66 within the housing 22 and intermediate front and rear wheels and generally aligned with them. There is a small gear 68 mounted coaxially with the flywheel. An intermediate gear 70 is also rotatably mounted within the housing 22 and meshes with the small gear 68 on the flywheel and with the gear 64 on the rear drive wheel. Thus a power-transmitting train is provided between the rear drive wheel and the flywheel by the gears 68, 70, 64. The side pins 46 at the rear of the bifurcated rear frame portion extend outwardly to either side. The toy motorcycle simulates the appearance of a real motorcycle and rider, and may be made of various suitable materials such as molded plastic.

Now considering the illustrated launcher 22 in further detail, the housing or base 32 is a generally box-like structure having the top platform wall 34, a removable bottom wall 72 and four side walls 74. At the rear end of the platform, there are a pair of spaced-apart upwardly extending fingers 76, each having a forwardly and downwardly extending end portion 78 which defines a recess 80 which provides the upper portion of a receptacle for the side pins 46 of the motorcycle. The recesses 80 are in fixed positions, open downwardly, and have essentially semi-circular configurations. The forward edge 82 of each finger 76 extends downwardly from a recess 80 to provide a stop or abuttment for a motorcycle side pin 46. The fingers 76 are spaced apart sufficiently to receive the rear end of the toy motorcycle between them so that the side pins 46 are received in the receptacles as shown in FIG. 2. The elongated narrow slot 36 is disposed centrally of the platform 34 and starting just forwardly of the fingers 76. The platform 34 continues forwardly to the downwardly inclined elongated ramp 54. At either side of the platform 34 starting just forwardly of the fingers 76 and extending the full length of the ramp 54 at either side is an upstanding curb 84.

Figure 3:
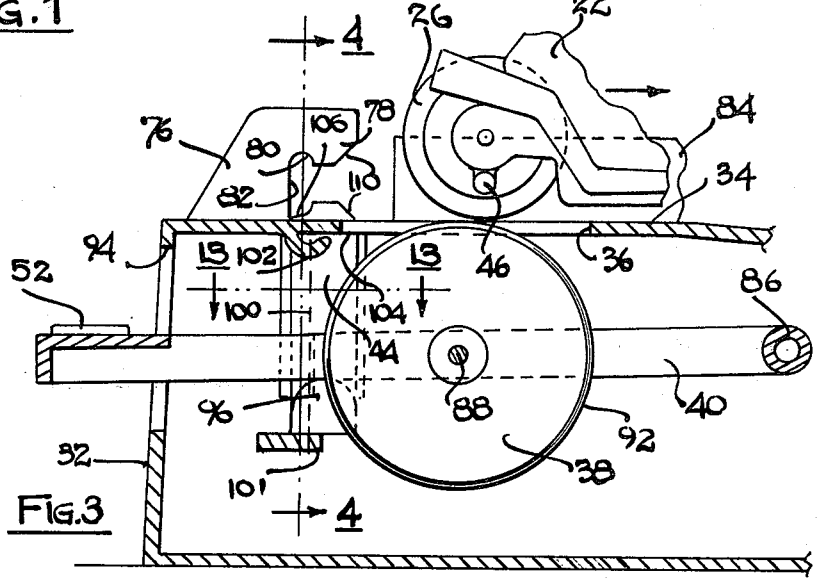
FIG. 3 is a view similar to FIG. 2, showing the relative parts shortly after the toy motorcycle has been released by the launcher.
Figure 4:
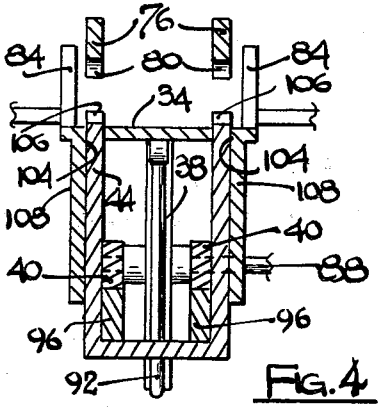
FIG. 4 is a sectional view taken generally along line 4—4 of FIG. 3.

The elongated bifurcated arm 40 is pivotally mounted at its forward end on a transverse shaft 86 supported between opposed upright walls of the ramp. The energy-imparting wheel 38 is rotatably supported on a shaft 88 between the bifurcated side portions of the arm 40 about midway between the ends of the arm. The wheel 38 has a spacing hub 87 at either side to maintain its properly spaced between the side portions of the arm 40. As seen in FIG. 1, one end of the shaft 88 continues to one side and is joined to or comprises an integral extension of the output shaft of the motor 42. As also shown in FIG. 1, the motor 42 is suitably mounted by support means 90 secured to the arm 40 for movement with the arm. The wheel 38 is aligned with the slot 36 in the platform so that the upper portion of the wheel 38 may pass through that slot as illustrated in FIG. 2. The wheel 38 has a rubber rim 92 to provide a high-friction contact surface for engaging and driving the motorcycle flywheel. An opening 93 in the bottom of the motorcycle frame provides access to the flywheel. The outer end of the arm 40 extends through a vertical slot 94 in the rear wall 74 of the housing and provides a manually depressible control handle 52 for the user. The arm 40 is also coupled to the generally U-shaped support or yoke 44; the upper ends of the legs of the yoke cooperate with the fingers 76 to support and retain the rear end of the toy motorcycle. More particularly, at the inside of the lower end of each leg of the yoke 44 there is a short cam block 96 having a curved upper surface for engaging one of the side portions of the arm 40. The yoke 44 is normally biased upwardly to a position such as shown in FIG. 2. The arm 40 will normally rest by virtue of its weight on the cam blocks 96 (this position of the arm 40 not shown in the drawings: the arm 40 is shown in FIG. 2 in a manually raised position to be explained below). When the arm 40 is manually depressed to a position such as shown in FIG. 3, the arm bears against the cam blocks 96 and thus depresses the upwardly biased yoke 44 to the position shown in that FIG. 3.

Figure 13:
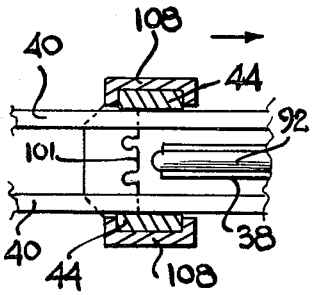
FIG. 13 is a sectional view taken generally along line 13—13 of FIG. 3.

As shown in FIG. 13, the yoke 44 is disposed for vertical reciprocating movement within an opposed pair of U-shaped guides 108 that depend from the underside of platform wall 34. The upper ends of the legs of the yoke 44 extend upwardly through openings 104 in the platform wall 34 and they are generally aligned with the stationary fingers 76. The upper ends of the yoke legs each have a curved cut-out or recess 106 which matches one of the upper recesses 80, for forming a receptacle that supports and restrains the side pins 46 on the toy motorcycle as shown in FIG. 2. A biasing means such as a spring or rubber band represented by the broken line 100 in FIG. 4 tends to urge the yoke 44 upwardly to the position of FIG. 2. The biasing means 100 may be secured between a tab 101 on the lower transverse portion of the yoke 44 and a tab 102 formed at the upper wall of the housing. Upward pivotal movement of the arm 40 may be limited as shown in FIG. 2 by its engagement with the upper end of slot 94.

To mount the toy motorcycle 20 on the launcher 22, the motorcycle may simply be disposed upright and centrally on the platform 34, and then pushed rearwardly so that the side pins 46 temporarily shift the biased yoke 44 downwardly to permit the pins to move partially past the yoke upper ends to where the pins are supported and retained by the upwardly biased yoke and the stationary fingers 76 (FIG. 2). This latching of the pins 46 is facilitated by forwardly facing cam surfaces 110 on the finger portions 78 and the yoke upper ends. At this time, the arm 40 will assume a position (not shown) by virtue of its weight where it rests upon the cam blocks 96 and the energy-imparting wheel 38 is out of contact with the motorcycle flywheel. When so mounted, the toy motorcycle as shown in FIG. 2 is supported with its rear drive wheel 26 off the platform 34 so that the drive wheel can rotate freely. The motorcycle is held by the side pins 46 being supported and retained in the receptacles 80, 106 formed by the stationary fingers 76 and the upwardly positioned yoke upper ends. When the arm 40 is in this position, the motor switch 50 is still open so the motor is off.

The user then grasps the control handle 52 of the arm 40 and lifts it upwardly. This first engages switch 50 to complete the circuit between the batteries 48 and the motor 42 to energize the motor to cause rotation of the wheel 38. As the arm continues upwardly, the edge of the now-rotating wheel 38 is urged against the edge of the motorcycle flywheel to impart rotation to the flywheel. It should be noted that the pivotal support of the motorcycle by the side pins 46 permits the portions of the motorcycle forwardly of the pins 46 (including the flywheel) to pivot counterclockwise as the wheel 38 applies upward force to the flywheel. Only the weight of the motorcycle maintains it urged against the wheel 38. This arrangement prevents the wheel 38 from being jammed against a rididly supported flywheel and stalling the motor or breaking parts of the device.

When the flywheel is rotating rapidly enough, the user may then depress the arm 40 by pushing downwardly on the control handle 52. The arm first moves downwardly relative to the yoke 44 to first disengage the wheel 38 from the flywheel and to then open the switch 50 and shut off the motor. The yoke 44 is maintained in the upward position during this time by the action of the spring 100. As the arm 40 is pivoted further downwardly, it engages the cam blocks 96 on the yoke 44 to lower the yoke and thus release the motorcycle: the rear drive wheel 26 engages the platform 34 and propels the motorcycle forwardly along the platform and down the ramp 54. When the arm 40 is released, the spring 100 will return the yoke 44 to its raised position for the next launching.

The manually or hand-powered launcher 122 is illustrated in FIGS. 9–12. This launcher 122 comprises an elongated generally flat horizontal ramp 154 having an upright rear wall 155, and a pair of upright curbs or side walls 153. Centrally and longitudionally along the top of the launching ramp 154 a strip 157 of high-friction material may be secured. At the rear end of the ramp 154 there are a pair of fixed abutments in the form of spaced-apart upright support walls 159 having notches 161 in their forward ends, respectively. These notches 161 each define a stop surface at its rear end and a downwardly sloped lower edge. The notches 161 are proportioned and arranged to each receive one of the side pins 46 at the rear of the motorcycle. A slot 163 is also provided in the upper edge of the rear wall 155 of the launcher for a T-rack 165 to extend through. The launcher 122 may also include a handle 167 at one side of its rear end.

Figure 9:
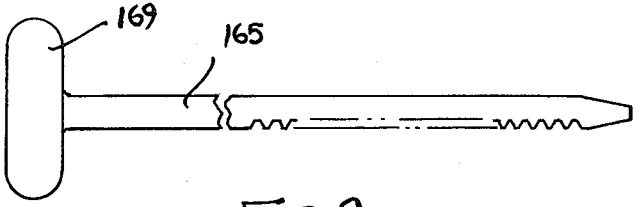
FIG. 9 illustrates an elongated flexible T-rack for use with a modified embodiment of the apparatus.
Figure 10:
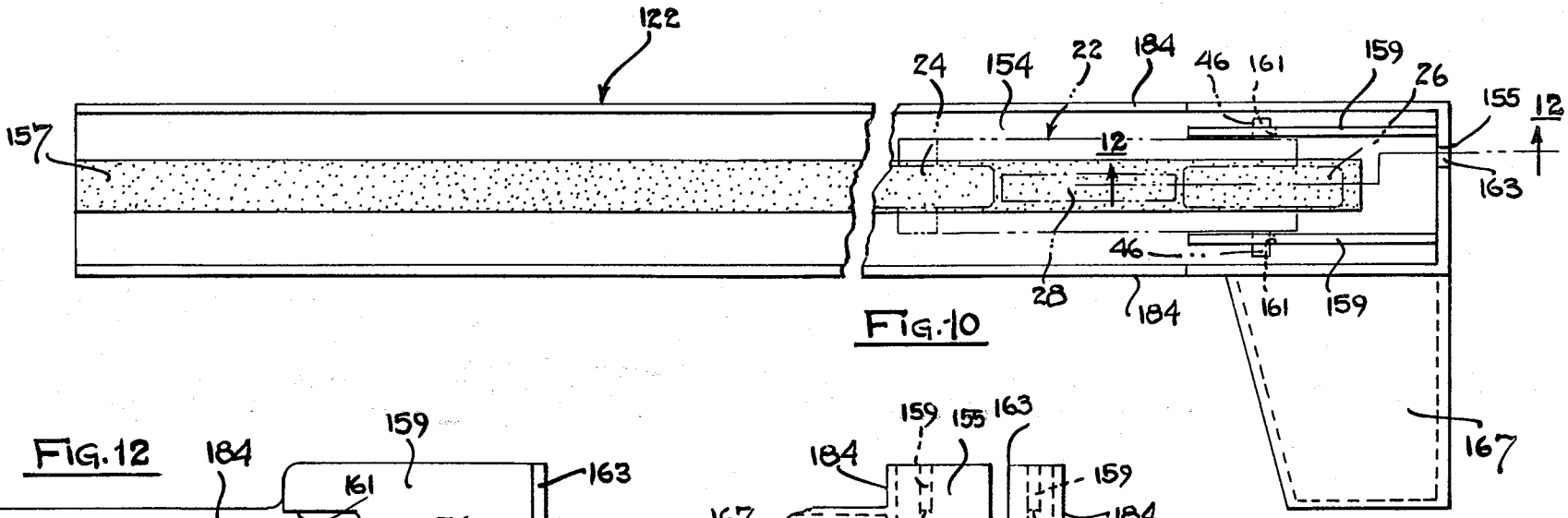
FIG. 10 is a plan view of a modified form of launching apparatus.
Figure 11:
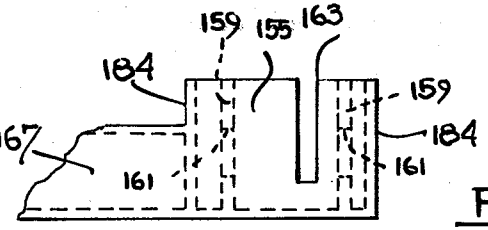
FIG. 11 is a rear end view of the apparatus of FIG. 10.
Figure 12:
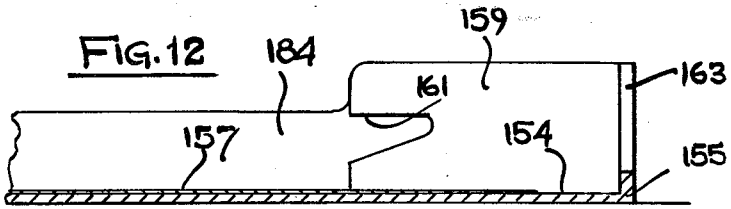
FIG. 12 is a sectional view taken generally along line 12—12 of FIG. 10.

FIG. 9 shows a conventional energy-imparting T-shaped pull rack 165 which has a pull handle 169 and may be formed of any suitable material such as flexible plastic or hard rubber. FIG. 7A shows a guide 173 which defines a space or opening at the rear of the toy motorcycle adjacent a gear 171 on the rear drive wheel axle 60 opposite gear 64. The forward end of the pull rack 165 may be inserted through the opening 170 and push forwardly; the rack meshes with the gear 171 and is held against it by the guide 173; the drive train simply rotates until the rack is fully inserted in the forward direction. With the rack thus in the ready position in the toy motorcycle, the motorcycle may be positioned on the launcher 122 with the side pins 46 in the slots 161 and the rear end of pull rack 165 extending through the vertical slot 163 to position its handle 169 rearwardly of the launcher rear wall 155. To launch the toy motorcycle 20 from the launcher 122, the user simply holds the launcher handle 167 with one hand and grasps and pulls rearwardly on the rack handle 169 with the other hand. Rearward movement of the rack 165 will initially draw the side pins 46 of the motorcycle to the stop surfaces at the rear ends of the slots 161. By virtue of the location and configuration of the slots 161 the rear drive wheel 26 will be lifted off the ramp 154 and will be free to rotate. Continued rearward movement of the rack 165 imparts rotation to the gear 171 on the drive wheel and thus to the entire gear train and flywheel 28 of the toy motorcycle. When the rack has completely passed and disengaged from the gear 171 on the motorcycle drive wheel, the motorcycle drive train will be rotating rapidly and the motorcycle, by virtue of its weight and the reaction to the release of the rack, will move down the inclined lower edges of the slots 161 until the drive wheel engages the ramp. As noted above, rotational energy is stored in the flywheel and is transmitted by the speed reducing but power and duration increasing gear train to the rear drive wheel. Flywheel also acts to maintain the toy motorcycle upright by gyroscopic action as it moves forwardly.

It will be apparent that the pull rack 165 may also be used with the illustrated toy motorcycle without the launcher. The user may simply hold the motorcycle in one hand and the rack in the other, insert the rack forwardly into the opening 170 to the forward ready position, and pull the rack rearwardly to impart rotation to the motorcycle drive-train mechanism. As soon as the rack releases and is disengaged from the motorcycle, the motorcycle may be placed upon the ground or forward movement.

Various modifications and changes may be made in the illustrated structure without departing from the spirit and scope of the present invention. While the illustrated motorcycle toy is advantageously used in combination with the illustrated launchers, each of the launchers might advantageously be used with somewhat different construction or configuration motorcycle or toy vehicle. Similarly, the launchers could themselves be modified in various respects as desired. By way of example, the motor might be powered by means of an electrical cord which plugs into a wall socket rather than by use of batteries. Similarly, the energy-imparting wheel might be hand-powered. Further, while it is advantageous to mount the motor on the same arm which carries the energy-imparting wheel, the motor means could be stationarily mounted and coupled to the energy-imparting wheel as by means of a drive-belt arrangement. The details of the structure for elevating, retaining and releasing the toy motorcycle may also be modified. In this connection, by way of example, the location of the projections on the motorcycle and the recepticles or slots on the launchers could essentially be reversed. It would also be possible to couple the movement of the arm and the energy-imparting wheel and the turning off and on of the motor to the mounting or latching of the vehicle onto the launcher, so that the motor was turned on and brought into contact with the vehicle flywheel automatically when the vehicle was mounted on the launcher. Mechanism could also be provided for automatically releasing the motorcycle after a certain amount of time or a certain amount of rotational speed had been obtained. The details of the hand-powered launcher could also be modified, as for example, by using a pull string instead of a toothed rack. While such and other modifications are within the contemplated scope of the present invention, the illustrated embodiments are the presently preferred forms of the invention and provide improved, simple and effective devices to accomplish the intended purposes and objectives, considering such things as cost of manufacture and assembly, ease of operation and simplicity as well as durability. The precise scope of the invention is as set forth in the following claims.

What is claimed is:

1. Toy motorcycle play apparatus comprising:

(a) a two-wheeled toy motorcycle having a frame and a generally aligned rotatable front rear ground-engaging wheels and an intermediate flywheel, all mounted on the frame and rotatable about generally horizontal transverse axes; said motorcycle being non-selfstanding in the stationary position; one of said ground-engaging wheels being a drive wheel; the flywheel and the drive wheel being operatively coupled together by a gear train which reduces the speed and increases the power and duration of rotation at the drive wheel; the flywheel, gear train and the drive wheel comprising an energy-storing drive-train mechanism; the toy motorcycle, when in operation, being powered and gyroscopically balanced by the flywheel; said frame having engagement means thereon; and (b) a launcher having a platform and control means for releasibly supporting and holding the motorcycle on the platform in an upright forwardly aligned position with its drive wheel out of engagement with the platform so that the drive wheel can rotate freely; for imparting rotation to the flywheel; and for releasing the motorcycle and allowing the rotating drive wheel to engage the platform to propel the motorcycle forwardly said control means including generally vertically movable engagement means on the launcher for movement to an upper position where it releasibly engages said motorcycle engagement means to elevate the drive wheel above the platform, to support the motorcycle in said upright position and to restrain forward movement of the motorcycle while rotation is being imparted to the flywheel, and for movement to a lower position where it disengages from said motorcycle engagement means to lower the drive wheel and release the motorcycle.

2. The play apparatus of claim 1 wherein said motorcycle rear wheel is the drive wheel and there are fixed connection means on the motorcycle frame adjacent the rear wheel for being releasibly held and supported by the launcher control means, said control means being manually operable to inpart rotation to the flywheel and to then release said connection means.

3. The play apparatus of claim 2 wherein said rear and front wheel and flywheel are generally disposed in a common vertical plane down the center of the motorcycle, the axes for said three wheels all being fixed in location relative to the frame.

4. The play apparatus of claim 3 wherein said gear train comprises a small gear coaxially mounted for common rotation with the flywheel, a large gear coaxially mounted for common rotation with said rear drive wheel and an intermediate gear meshing with both said small and large gears and being intermediate in size to said small and large gears, said gears being generally disposed in a common vertical plane parallel to the plane of said front and rear wheels and flywheel.

5. The play apparatus of claim 4 wherein the gear reduction ratio of said gear train is approximately 3:1.

6. The play apparatus of claim 2 wherein said connection means comprise an outwardly extending projection at each side of said motorcycle.

7. The play apparatus of claim 1 wherein said control means of said launcher comprises:

(a) an energy-imparting wheel;

(b) an arm on said launcher for supporting said energy-imparting wheel both for rotation about a generally horizontal transversely extending axis and for vertical movement, said energy-imparting wheel being positioned for movement into and out of engagement with the motorcycle flywheel when the toy motorcycle is supported and held on the launcher; and (c) motor means operatively connected to the energy-imparting wheel for rotating said energy-imparting wheel.

8. The play apparatus of claim 7 wherein said energy-imparting wheel is rotatably mounted on the movable arm and said motor means is also mounted on said arm coaxially with said energy-imparting wheel.

9. The play apparatus of claim 8 wherein said motor means is an electric motor coupled to said energy-imparting wheel and said control means further comprises circuit means on the launcher and including a switch, said switch being operable incident to movement of the arm to open and close the circuit to thereby energize and deenergize the electric motor.

10. The play apparatus of claim 9 wherein said circuit means further includes means for supporting one or more dry cell batteries and for connecting the batteries through the switch to the electric motor.

11. The play apparatus of claim 7 wherein said arm is movably mounted on said frame below the platform and the platform is provided with a longitudinal slot through which an upper portion of the energy-imparting wheel extends incident to movement of the arm, said slot being substantially narrower than the width of the motorcycle rear wheel.

12. The play apparatus of claim 11 wherein the peripheral edge of the energy-imparting wheel is aligned with and adapted to engage the peripheral edge of the flywheel of the motorcycle when the motorcycle is supported and held on the launcher platform.

13. The play apparatus of claim 8 wherein said launcher comprises a housing which contains said movable arm, said energy-imparting wheel, and said motor means; said platform comprising the upper wall of said housing; said launcher further comprising an elongated downwardly inclined ramp leading from said platform to the surface on which said launcher is supported.

14. The play apparatus of claim 1 wherein said launcher further comprises a fixed engagement means mounted on the platform and positioned and arranged to cooperate with one of the movable launcher engagement means to provide a receptacle for said motorcycle engagement means.

15. The play apparatus of claim 14 wherein said motorcycle engagement means is in the form of a projection which is freely rotatable within said receptacle and the toy motorcycle can pivot about said projection so that after engagement of the energy-imparting wheel with the flywheel, further upward movement of the energy-imparting wheel can be accommodated by the pivoting of the toy motorcycle about the projection.

16. Toy motorcycle play apparatus comprising:

(a) a two-wheeled toy motorcycle having a frame and a generally aligned rotatable frong and rear ground-engaging wheels and an intermediate flywheel, all mounted on the frame and rotatable about generally horizontal transverse axes; one of said ground-engaging wheels being a drive wheel; the flywheel and the drive wheel being operatively coupled together by a gear train which reduces the speed and increases the power and duration of rotation at the drive wheel; the flywheel, gear train and the drive wheel comprising an energy-storing drive-train mechanism; the toy motorcycle, when in operation, being powered and gyroscopically balanced by the flywheel; and (b) a launcher having a platform and control means for releasibly supporting and holding the motorcycle on the platform in an upright forwardly aligned position with its drive wheel out of engagement with the platform so that the drive wheel can rotate freely; for imparting rotation to the flywheel; and for releasing the motorcycle and allowing the rotating drive wheel to engage the platform to propel the motorcycle forwardly, said control means comprising:

(i) an energy-imparting wheel;

(ii) an arm on said launcher for supporting said energy-imparting wheel both for rotation about a generally horizontal transversely extending axis and for vertical movement, said energy-imparting wheel being positioned for movement into and out of engagement with the motorcycle flywheel when the toy motorcycle is supported and held on the launcher; and (iii) motor means operatively connected to the energy-imparting wheel for rotating said energy-imparting wheel, said control means comprising movable support means coupled to said movable arm, said support means being movable incident to movement of said arm between a raised position extending above the platform to engage the motorcycle and raise its drive wheel off the platform, and a lowered position which permits the drive wheel to engage the platform.

17. The play apparatus of claim 16 wherein said toy motorcycle has an outwardly extending projection at either side of its rear portion, and said movable support means comprises a pair of fingers, one disposed at either side of the motorcycle when the motorcycle is mounted on the launcher platform for engaging and elevating one of the projections.

18. The play apparatus of claim 17 wherein said movable support means comprises a generally U-shaped yoke, each leg of which provides one of said fingers.

19. The play apparatus of claim 18 wherein said yoke is spring biased toward the raised position.

20. The play apparatus of claim 17 wherein said launcher further comprises a pair of fixed fingers mounted on the platform and each positioned and arranged to cooperate with one of the movable support fingers to provide a receptacle for one of said projections on the toy motorcycle.

21. The play apparatus of claim 20 wherein said projections are freely rotatable within said receptacles and the toy motorcycle can pivot about said projections so that after engagement of the energy-imparting wheel with the flywheel, further upward movement of the energy-imparting wheel can be accommodated by the pivoting of the toy motorcycle about the projections.

22. The play apparatus of claim 20 wherein said fingers include camming surfaces to facilitate insertion of the motorcycle projections into the receptacles when positioning the motorcycle on the platform.

23. The play apparatus of claim 16 wherein said movable support means is biased to the raised position and movable by movement of the arm to the lowered position.

24. The play apparatus of claim 23 wherein said movable support means and said arm are coupled in such a manner that the energy-imparting wheel may be moved out of engagement with the motorcycle flywheel by initial movement of the arm without moving the support means from its raised position, and the movable support means may be moved from a raised to a lowered position by subsequent continued movement of the arm.

25. The play apparatus of claim 16 wherein said motorcycle has projection means and said launcher further comprises fixed abutment means mounted on the platform and being positioned and arranged to cooperate with said movable support means to provide a receptacle for receipt of said projection means.

26. The play apparatus of claim 25 wherein said projection means is pivotally received in said receptacle.

27. Toy motorcycle play apparatus comprising:

(a) a two-wheeled toy motorcycle having a frame and a generally aligned rotatable front and rear ground-engaging wheels and an intermediate flywheel, all mounted on the frame and rotatable about generally horizontal transverse axes; one of said ground-engaging wheels being a drive wheel; the flywheel and the drive wheel being operatively coupled together by a gear train which reduces the speed and increases the power and duration of rotation at the drive wheel; the flywheel, gear train and the drive wheel comprising an energy-storing drive-train mechanism; the toy motorcycle, when in operation, being powered and gyroscopically balanced by the flywheel; and (b) a launcher having a platform and control means for releasibly supporting and holding the motorcycle on the platform in an upright forwardly aligned position with its drive wheel out of engagement with the platform so that the drive wheel can rotate freely; for imparting rotation to the flywheel; and for releasing the motorcycle and allowing the rotating drive wheel to engage the platform to propel the motorcycle forwardly, said control means comprising:

(i) an energy-imparting wheel;

(ii) an arm on said launcher for supporting said energy-imparting wheel both for rotation about a generally horizontal transversely extending axis and for vertical movement, said energy-imparting wheel being positioned for movement into and out of engagement with the motorcycle flywheel when the toy motorcycle is supported and held on the launcher; and (iii) motor means operatively connected to the energy-imparting wheel for rotating said energy-imparting wheel, said arm being movably mounted on said frame below the platform and the platform being provided with the longitudinal slot through which an upper portion of the energy-imparting wheel extends incident to movement of the arm, said slot being substantially narrower than the width of the motorcycle rear wheel, the peripheral edge of the energy-imparting wheel being aligned with and adapted to engage the peripheral edge of the flywheel of the motorcycle when the motorcycle is supported and held on the launcher platform, said arm being pivotally mounted on the launcher and a portion thereof extending outwardly of the launcher to provide a control handle.

28. Toy vehicle play apparatus comprising:

(a) a wheeled vehicle having a frame and an energy-storing drive train mechanism including at least one contact wheel mounted on the frame for rotation about a generally horizontal transverse axis; said mechanism including at least one ground-engaging drive wheel rotatably mounted on said frame; and (b) a launcher having a platform and control means for releasibly supporting and holding the vehicle on the platform in a forwardly aligned position with said drive wheel out of engagement with the platform so that the drive wheel can rotate freely; for imparting rotation and energy to the contact wheel; and for releasing the vehicle and allowing the drive wheel to engage the platform to propel the vehicle forwardly, said control means comprising:

(1) an energy-imparting wheel;

(2) an arm movably mounted on the launcher for supporting the energy-imparting wheel both for rotation about a generally horizontal transversely extending axis and for vertical movement, said energy-imparting wheel being positioned for movement into and out of engagement with the vehicle gear train when the toy vehicle is supported and held on the launcher; and (3) motor means operatively connected to the energy-imparting wheel for rotating said wheel, said arm being movably mounted on said frame below the platform and the platform being provided with a longitudinal slot through which an upper portion of the energy-imparting wheel extends incident to movement of the arm, said slot being substantially narrower than the width of the vehicle rear wheel, the vehicle gear train including a flywheel and the peripheral edge of the energy-imparting wheel being aligned with and adapted to engage the peripheral edge of the flywheel when the vehicle is supported and held on the launcher platform, said arm being pivotally mounted on the launcher and a portion thereof extending outwardly of the launcher to provide a control handle.

29. Toy motorcycle apparatus comprising:

(a) a two-wheeled toy motorcycle having a frame and a generally aligned rotatable front and rear ground-engaging wheels and an intermediate flywheel, all mounted on the frame and rotatable about generally horizontal transverse axes; one of said ground-engaging wheels being a drive wheel; the flywheel and the drive wheel being operatively coupled together by a gear train which reduces the speed and increases the power and duration of rotation at the drive wheel; the flywheel, gear train and the drive wheel comprising an energy-storing drive-train mechanism; the toy motorcycle, when in opeation, being powered and gyroscopically balanced by the flywheel; and (b) energy-imparting means releasibly engagable with said energy-storing drive-train mechanism and operable to impart energy to said mechanism while said drive wheel is out of engagement with the ground or any other supporting surface and thereby free to rotate, said rear and front wheels and flywheel being generally disposed in a common vertical plane down the center of the motorcycle, the axes for said three wheels all being fixed in location relative to the frame, said drive wheel being the rearwheel and said gear train comprises a small gear coaxially mounted for common rotation with the flywheel, a large gear coaxially mounted for common rotation with said rear drive wheel and an intermediate gear meshing with both said small and large gears and being intermediate in size to said small and large gears, said gears being generally disposed in a common vertical plane parallel to the plane of said front and rear wheels and flywheel, there being an additional small gear coaxially mounted for common rotation with said rear drive wheel on the opposite side thereof from said large gear, said frame further including an abuttment guide section positioned adjacent to but sufficiently spaced from said additional small gear to define a pathway adjacent to said additional small gear, said pathway extending front-to-back and generally horizontally and proportioned to receive therethrough a toothed pull rack meshed with said additional small gear, said energy-imparting means being in the form of a hand-pullable separate toothed rack member which engages with said additional small gear while energy is being transferred, and which then disengages from said additional small gear.

30. Toy vehicle play apparatus comprising:

(a) a wheeled vehicle having a frame and an energy-storing drive train mechanism including at least one contact wheel mounted on the frame for rotation about a generally horizontal transverse axis; said mechanism including at least one ground-engaging drive wheel rotatably mounted on said frame; and (b) a launcher having a platform and control means for releasibly supporting and holding the vehicle on the platform in a forwardly aligned position with said drive wheel out of engagement with the platform so that the drive wheel can rotate freely; for imparting rotation and energy to the contact wheel; and for releasing the vehicle and allowing the drive wheel to engage the platform to propel the vehicle forwardly, said control means comprising:

(1) an energy-imparting wheel;

(2) an arm movably mounted on the launcher for supporting the energy-imparting wheel both for rotation about a generally horizontal transversely extending axis and for vertical movement, said energy-imparting wheel being positioned for movement into and out of engagement with the vehicle drive-train when the toy vehicle is supported and held on the launcher; and (3) motor means operatively connected to the energy-imparting wheel for rotating said wheel, said control means comprising movable support means coupled to said movable arm, said support means being movable incident to movement of said arm between a raised position extending above the platform to engage the vehicle and raise its drive wheel off the platform, and a lowered position which permits the drive wheel to engage the platform.

31. The play apparatus of claim 30 wherein said movable support means is biased to the raised position and movable by movement of the arm to the lowered position.

32. The play apparatus of claim 31 wherein said movable support means and said arm are coupled in such a manner that the energy-imparting wheel may be moved out of engagement with the vehicle flywheel by initial movement of the arm without moving the support means from its raised position, and the movable support means may be moved from a raised to a lowered position by subsequent continued movement of the arm.

33. The play apparatus of claim 30 wherein said toy vehicle has an outwardly extending projection at either side of its rear portion, and said movable support means comprises a pair of fingers, one disposed at either side of the vehicle when the vehicle is mounted on the launcher platform for engaging and elevating one of the projections.

34. The play apparatus of claim 33 wherein said launcher further comprises a pair of fixed fingers mounted on the platform and each positioned and arranged to cooperate with one of the movable support fingers to provide a receptacle for rotatably receiving one of said projections on the toy vehicle.

35. The play apparatus of claim 30 wherein said vehicle has projection means and said launcher further comprises fixed abutment means mounted on the platform and being positioned and arranged to cooperate with said movable support means to provide a receptacle for receipt of said projection means.

36. Toy vehicle play apparatus comprising:

(a) a wheeled vehicle having a frame and an energy-storing drive train mechanism including at least one contact wheel mounted on the frame for rotation about a generally horizontal transverse axis; said mechanism including at least one ground-engaging drive wheel rotatably mounted on said frame; and (b) a launcher having a platform and control means for releasibly supporting and holding the vehicle on the platform in a forwardly aligned position with said drive wheel out of engagement with the platform so that the drive wheel can rotate freely; for imparting rotation and energy to the contact wheel; and for releasing the vehicle and allowing the drive wheel to engage the platform to propel the vehicle forwardly, said control means comprising:

(1) an energy-imparting wheel;

(2) an arm movably mounted on the launcher for supporting the energy-imparting wheel both for rotation about a generally horizontal transversely extending axis and for vertical movement, said energy-imparting wheel being positioned for movement into and out of engagement with the vehicle drive train when the toy vehicle is supported and held on the launcher; and (3) motor means carried on said arm and operatively connected to the energy-imparting wheel for rotating said wheel.

37. The play apparatus of claim 36 wherein said motor means is an electric motor coupled to said energy-imparting wheel and said control means further comprises circuit means on the launcher and including a switch, said switch being operable incident to movement of the arm to open and close the circuit to thereby energize and deenergize the electric motor.

38. The play apparatus of claim 37 wherein said circuit means further includes means for supporting one or more dry cell batteries and for connecting the batteries through the switch to the electric motor.

39. The play apparatus of claim 36 wherein said arm is movably mounted on said frame below the platform and the platform is provided with a longitudinal slot through which an upper portion of the energy-imparting wheel extends incident to movement of the arm, said slot being substantially narrower than the width of the vehicle rear wheel.

40. The play apparatus of claim 39 wherein the vehicle gear train includes a flywheel and the peripheral edge of the energy-imparting wheel is aligned with and adapted to engage the peripheral edge of the flywheel when the vehicle is supported and held on the launcher platform.

41. Toy motorcycle play apparatus comprising:

(a) a two-wheeled toy motorcycle having a frame and an energy-storing drive-train mechanism including at least one ground-engaging rear wheel rotatably mounted on said frame; said motorcycle having projection means fixed on said frame adjacent said rear wheel; and (b) a launcher having a platform and control means for releasably supporting and holding the toy motorcycle on the platform in a forwardly aligned position with said rear drive wheel out of engagement with the platform so that the drive wheel can rotate freely; for imparting rotation of said drive wheel; and for releasing the motorcycle and allowing the drive wheel to engage the platform to propel the motorcycle forwardly; said control means including fixed abutment means on said platform defining at least one forwardly facing stop surface and at least one downwardly inclined relief surface, said control means comprising hand movable rotation-imparting means engagable with the motorcycle energy-storing drive-train mechanism and operable to urge the toy motorcycle rearwardly against the stop surface while imparting rotation to said mechanism and for then permitting said projection means on the motorcycle to move down said release surface so that the rotating drive wheel may engage the platform for launching of the toy motorcycle, said hand movable rotation-imparting means being in the form of a hand-pullable separate member which engages with said energy-storing drive train mechanism on the toy motorcycle while energy is being transferred, and which then disengages from said mechanism, said launcher including means which guide the pull member, said guide means being disposed on the launcher rearwardly of said fixed abutment means and comprising a transverse rear wall section having an upper edge and a pull slot extending downwardly from said upper edge for receiving said pull member therein, whereby said pull member may be engaged with said toy motorcycle and the motorcycle and pull member may be positioned on the launcher as a unit.

42. The play apparatus of claim 41 wherein said projection means comprises a projecting pin at either side of the rear of the toy motorcycle and said abutment means comprises a spaced-apart pair of abutment members each engagable with one of said projection pins.

43. The play apparatus of claim 42 wherein each of said abutment members comprises a generally upright wall section having a forwardly open slot in its forward edge, each of said downwardly inclined relief surfaces being provided by the lower edge of one of said slots.

44. The play apparatus of claim 41 wherein said pull member has an enlarged pull handle for being disposed rearwardly of said pull slot.

* * * * *